US009847074B2

(12) United States Patent
Kim

(10) Patent No.: US 9,847,074 B2
(45) Date of Patent: Dec. 19, 2017

(54) DATA COMPENSATION DEVICE AND DISPLAY DEVICE INCLUDING THE SAME

(71) Applicant: Samsung Display Co., Ltd., Yongin-si, Gyeonggi-do (KR)

(72) Inventor: Jong-Woon Kim, Cheongju-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 162 days.

(21) Appl. No.: 14/836,261

(22) Filed: Aug. 26, 2015

(65) Prior Publication Data

US 2016/0267876 A1 Sep. 15, 2016

(30) Foreign Application Priority Data

Mar. 13, 2015 (KR) ..... 10-2015-0034800

(51) Int. Cl.
*G09G 5/10* (2006.01)
*G09G 3/20* (2006.01)

(52) U.S. Cl.
CPC ..... *G09G 5/10* (2013.01); *G09G 3/2003* (2013.01); *G09G 2320/0242* (2013.01); *G09G 2320/0276* (2013.01); *G09G 2320/0646* (2013.01); *G09G 2320/0673* (2013.01); *G09G 2360/12* (2013.01)

(58) Field of Classification Search
CPC ..... G09G 5/10; G09G 3/2003; G09G 2320/0242; G09G 2320/0673; G09G 2320/0276; G09G 2320/0646; G09G 2360/12
USPC ..... 345/690
See application file for complete search history.

(56) References Cited

U.S. PATENT DOCUMENTS

2007/0132689 A1* 6/2007 Li ..... G09G 3/006 345/89
2007/0195045 A1* 8/2007 Kaneki ..... G09G 3/3614 345/96
2010/0073339 A1* 3/2010 Lee ..... G09G 3/20 345/207

(Continued)

FOREIGN PATENT DOCUMENTS

KR 10-2011-0022444 A 3/2011
KR 10-2011-0099981 A 9/2011
KR 10-2013-0142748 A 12/2013

*Primary Examiner* — Jonathan Boyd
(74) *Attorney, Agent, or Firm* — Knobbe Martens Olson & Bear, LLP

(57) ABSTRACT

A display device and a data compensating device for a display device are disclosed. In one aspect, the data compensating device includes a converter configured to convert image data corresponding to a plurality of pixels in a display panel into input grayscale data and provide the input grayscale data. A brightness ratio calculator is configured to calculate a brightness ratio of the input grayscale data for each pixel based on a predetermined gamma value and a maximum grayscale data. The data compensating device also includes a compensating coefficient output unit configured to output a predetermined compensating coefficient based on the brightness ratio, and a compensating data calculator configured to calculate compensating grayscale data corresponding to all of the grayscale data based on the compensating coefficient. A data output unit is configured to provide the compensating grayscale data corresponding to the input grayscale data as output grayscale data to the pixels.

16 Claims, 5 Drawing Sheets

(56) References Cited

U.S. PATENT DOCUMENTS

| | | | | |
|---|---|---|---|---|
| 2010/0109992 | A1* | 5/2010 | Sumi | G09G 3/3648 345/89 |
| 2010/0265262 | A1* | 10/2010 | Choe | G09G 3/342 345/589 |
| 2011/0150359 | A1* | 6/2011 | Hwang | G09G 3/3225 382/274 |
| 2014/0254639 | A1 | 9/2014 | Tahir et al. | |

* cited by examiner

DATA COMPENSATION DEVICE AND DISPLAY DEVICE INCLUDING THE SAME

CROSS-REFERENCE TO RELATED APPLICATION(S)

This application claims priority under 35 USC §119 to Korean Patent Application No. 10-2015-0034800, filed on Mar. 13, 2015 in the Korean Intellectual Property Office (KIPO), the contents of which are incorporated herein in its entirety by reference.

BACKGROUND

Field

The described technology generally relates to a data compensating device and a display device including the same.

Description of the Related Technology

Flat panel displays (FPDs) are widely used in electronic devices because FPDs are relatively lightweight and thin compared to cathode-ray tube (CRT) displays. Examples of FPDs include liquid crystal displays (LCDs), field emission displays (FEDs), plasma display panels (PDPs), and organic light-emitting diode (OLED) displays. OLED technology is considered a next-generation technology because the OLEDs have various advantages such as a wide viewing angle, a rapid response speed, a thin profile, low power consumption, etc.

Power consumption of the display device can increase as the size of the display device and the quality of the display device increase. In order to reduce the power consumption, an automatic current limitation (ACL) driving technology can be used. The ACL driving technology reduces consumption of current by controlling the amount of current consumed in a display panel.

SUMMARY OF CERTAIN INVENTIVE ASPECTS

One inventive aspect relates to a data compensating device that can improve a display quality when the ACL driving technology is used.

Another aspect is a display device that can improve a display quality when the ACL driving technology is used.

Another aspect is a data compensating device that includes a converter configured to generate an input grayscale data by converting an image data provided to a plurality of pixels in a display panel, a brightness ratio calculator configured to calculate a brightness ratio of the input grayscale data provided to each of the pixels based on a predetermined gamma value and a maximum grayscale data, a compensating coefficient output unit configured to output a predetermined compensating coefficient based on the brightness ratio of the input grayscale data, a compensating data calculator configured to calculate a compensating grayscale data corresponding to all of the grayscale data based on the compensating coefficient, and a data output unit configured to output the compensating grayscale data corresponding to the input grayscale data as an output grayscale data.

In example embodiments, the brightness ratio calculator calculates the brightness ratio based on an equation, $$R = \left(\frac{Gin}{G\ \max}\right)^{\gamma},$$

where R is the brightness ratio, Gin is the input grayscale data, Gmax is the maximum grayscale data, and γ is the gamma value.

In example embodiments, the compensating coefficient output unit includes a storage configured to store the compensating coefficient corresponding to the brightness ratio, a calculator configured to calculate a mean value of the brightness ratio of the input grayscale data provided from the brightness ratio calculator during a frame, and a selector configured to select the compensating coefficient corresponding to the mean value from the storage.

In example embodiments, the storage is implemented as a look up table (LUT) that stores the compensating coefficient corresponding to the brightness ratio.

In example embodiments, the compensating data calculator calculates the compensating grayscale data corresponding to all of the grayscale data based on an equation, $$Gc = Gx - \left(\frac{Gx}{G\ \max} \times Cc\right),$$

where Gc is the compensating grayscale data, Gx is the grayscale data, Gmax is the maximum grayscale data, and Cc is the compensating coefficient.

In example embodiments, the compensating data calculator calculates the compensating grayscale data corresponding to all of the grayscale data based on an equation, $$Gc = Gx - \left[\left(\frac{Gx}{G\ \max}\right)^{\gamma} \times Cc\right],$$

where, the Gc is the compensating grayscale data, Gx is the grayscale data, Gmax is the maximum grayscale data, γ is the gamma value, and Cc is the compensating coefficient.

In example embodiments, the data output unit outputs the compensating grayscale data corresponding to the input grayscale data of a next frame provided from the converter as the output grayscale data.

In example embodiments, the converter further includes a frame memory configured to store the input grayscale data per a frame.

In example embodiments, the data output unit outputs the compensating grayscale data corresponding to the input grayscale data stored in the frame memory as the output grayscale data.

According to an aspect of example embodiments, a display device includes a display panel including a plurality of pixels, a data compensator configured to convert image data provided to the pixels into input grayscale data, output a compensating coefficient based on a brightness ratio of the input grayscale data, and calculate the compensating data based on the compensating coefficient, a scan driver configured to provide a scan signal to the pixels, a data driver configured to provide a data signal of the pixels, and a timing controller configured to generate a control signal that controls the scan driver and the data driver.

In example embodiments, the data compensator includes a converter configured to generate the input grayscale data by converting the image data, a brightness ratio calculator configured to calculate the brightness ratio of the input grayscale data provided to each of the pixels based on a predetermined gamma value and a maximum grayscale data, a compensating coefficient output unit configured to output a predetermined compensating coefficient based on the brightness ratio of the input grayscale data, a compensating data calculator configured to calculate the compensating grayscale data corresponding to all of the grayscale data based on the compensating coefficient, and a data output unit configured to output the compensating grayscale data corresponding to the input grayscale data as an output grayscale data.

In example embodiments, the brightness ratio calculator calculates the brightness ratio based on an equation, $$R = \left(\frac{Gin}{G\ \max}\right)^{\gamma},$$

where R is the brightness ratio, Gin is the input grayscale data, Gmax is the maximum grayscale data, and γ is the gamma value.

In example embodiments, the compensating coefficient output unit includes a storage configured to store the compensating coefficient corresponding to the brightness ratio, a calculator configured to calculate a mean value of the brightness ratio of the input grayscale data provided from the brightness ratio calculator during a frame, and a selector configured to select the compensating coefficient corresponding to the mean value from the storage.

In example embodiments, the storage is implemented as a look up table (LUT) that stores the compensating coefficient corresponding to the brightness ratio.

In example embodiments, the compensating data calculator calculates the compensating grayscale data corresponding to all of the grayscale data based on an equation, $$Gc = Gx - \left(\frac{Gx}{G\ \max} \times Cc\right),$$

where the Gc is the compensating grayscale data, Gx is the grayscale data, Gmax is the maximum grayscale data, and Cc is the compensating coefficient.

In example embodiments, the compensating data calculator calculates the compensating grayscale data corresponding to all of the grayscale data based on an equation, $$Gc = Gx - \left[\left(\frac{Gx}{G\ \max}\right)^{\gamma} \times Cc\right],$$

where the Gc is the compensating grayscale data, Gx is the grayscale data, Gmax is the maximum grayscale data, γ is the gamma value, and Cc is the compensating coefficient.

In example embodiments, the data output unit outputs the compensating grayscale data corresponding to the input grayscale data of a next frame provided from the converter as the output grayscale data.

In example embodiments, the converter further includes a frame memory configured to store the input grayscale data per a frame.

In example embodiments, the data output unit outputs the compensating grayscale data corresponding to the input grayscale data stored in the frame memory as the output grayscale data.

In example embodiments, the data compensator is included in the timing controller or be coupled to the timing controller.

Another aspect is a data compensating device for a display device, comprising: a converter configured to convert image data corresponding to a plurality of pixels in a display panel into input grayscale data and provide the input grayscale data; a brightness ratio calculator configured to calculate a brightness ratio of the input grayscale data for each pixel based on a predetermined gamma value and a maximum grayscale data; a compensating coefficient output unit configured to output a predetermined compensating coefficient based on the brightness ratio; a compensating data calculator configured to calculate compensating grayscale data corresponding to all of the grayscale data based on the compensating coefficient; and a data output unit configured to provide the compensating grayscale data corresponding to the input grayscale data as output grayscale data to the pixels.

In the above data compensating device, the brightness ratio calculator is further configured to calculate the brightness ratio based on an equation, $$R = \left(\frac{Gin}{G\max}\right)^{\gamma},$$

where R is the brightness ratio, Gin is the input grayscale data, Gmax is the maximum grayscale data, and γ is the gamma value.

In the above data compensating device, the compensating coefficient output unit includes: a storage configured to store the compensating coefficient corresponding to the brightness ratio; a calculator configured to calculate a mean value of the brightness ratio of the input grayscale data for a frame; and a selector configured to select the compensating coefficient corresponding to the mean value from the storage.

In the above data compensating device, the storage includes a look up table (LUT) configured to store the compensating coefficient corresponding to the brightness ratio.

In the above data compensating device, the compensating data calculator is further configured to calculate the compensating grayscale data corresponding to all of the grayscale data based on an equation, $$Gc = Gx - \left(\frac{Gx}{G\max} \times Cc\right),$$

where Gc is the compensating grayscale data, Gx is the grayscale data, Gmax is the maximum grayscale data, and Cc is the compensating coefficient.

In the above data compensating device, the compensating data calculator is further configured to calculate the compensating grayscale data corresponding to all of the grayscale data based on an equation, $$Gc = Gx - \left[\left(\frac{Gx}{G\max}\right)^{\gamma} \times Cc\right],$$

where Gc is the compensating grayscale data, Gx is the grayscale data, Gmax is the maximum grayscale data, γ is the gamma value, and Cc is the compensating coefficient.

In the above data compensating device, the data output unit is further configured to output the compensating grayscale data corresponding to the input grayscale data of a next frame provided from the converter as the output grayscale data.

In the above data compensating device, the converter further includes a frame memory configured to store the input grayscale data every frame.

In the above data compensating device, the data output unit is further configured to output the compensating grayscale data corresponding to the input grayscale data stored in the frame memory as the output grayscale data.

Another aspect is a display device comprising: a display panel including a plurality of pixels; a data compensator configured to i) convert image data corresponding to the pixels into input grayscale data, ii) output a compensating coefficient based on a brightness ratio of the input grayscale data, and iii) calculate the compensating data based on the compensating coefficient; a scan driver configured to provide a scan signal to the pixels; a data driver configured to provide a data signal of the pixels; and a timing controller configured to generate a control signal so as to control the scan driver and the data driver.

In the above display device, the data compensator includes: a converter configured to convert the image data into the input grayscale data and provide the input grayscale data; a brightness ratio calculator configured to calculate the brightness ratio of the input grayscale data for each pixel based on a predetermined gamma value and a maximum grayscale data; a compensating coefficient output unit configured to output a predetermined compensating coefficient based on the brightness ratio; a compensating data calculator configured to calculate the compensating grayscale data corresponding to all of the grayscale data based on the compensating coefficient; and a data output unit configured to provide the compensating grayscale data corresponding to the input grayscale data as output grayscale data to the pixels.

In the above display device, the brightness ratio calculator is further configured to calculate the brightness ratio based on an equation, $$R = \left(\frac{Gin}{G\max}\right)^{\gamma},$$

where R is the brightness ratio, Gin is the input grayscale data, Gmax is the maximum grayscale data, and γ is the gamma value.

In the above display device, the compensating coefficient output unit includes: a storage configured to store the compensating coefficient corresponding to the brightness ratio; a calculator configured to calculate a mean value of the brightness ratio of the input grayscale data for a frame; and a selector configured to select the compensating coefficient corresponding to the mean value from the storage.

In the above display device, the storage includes a look up table (LUT) configured to store the compensating coefficient corresponding to the brightness ratio.

In the above display device, the compensating data calculator is further configured to calculate the compensating grayscale data corresponding to all of the grayscale data based on an equation, $$Gc = Gx - \left(\frac{Gx}{G\max} \times Cc\right),$$

where Gc is the compensating grayscale data, Gx is the grayscale data, Gmax is the maximum grayscale data, and Cc is the compensating coefficient.

In the above display device, the compensating data calculator is further configured to calculate the compensating grayscale data corresponding to all of the grayscale data based on an equation, $$Gc = Gx - \left[\left(\frac{Gx}{G\max}\right)^{\gamma} \times Cc\right],$$

where Gc is the compensating grayscale data, Gx is the grayscale data, Gmax is the maximum grayscale data, γ is the gamma value, and Cc is the compensating coefficient.

In the above display device, the data output unit is further configured to output the compensating grayscale data corresponding to the input grayscale data of a next frame provided from the converter as the output grayscale data.

In the above display device, the converter further includes a frame memory configured to store the input grayscale data every frame.

In the above display device, the data output unit is further configured to output the compensating grayscale data corresponding to the input grayscale data stored in the frame memory as the output grayscale data.

In the above display device, the data compensator is included in the timing controller or is coupled to the timing controller.

According to at least one of the disclosed embodiments, a data compensating device can prevent changing of a display property when the ACL driving technology is used by compensating an image data provided to the display panel based on a brightness ratio. Thus, a display quality of the display device that includes the data compensating device can improve.

BRIEF DESCRIPTION OF THE DRAWINGS

FIG. 6 is implemented as a smartphone.

DETAILED DESCRIPTION OF CERTAIN INVENTIVE EMBODIMENTS

Hereinafter, the described technology will be explained in detail with reference to the accompanying drawings. In this disclosure, the term "substantially" includes the meanings of completely, almost completely or to any significant degree under some applications and in accordance with those skilled in the art. Moreover, "formed on" can also mean "formed over." The term "connected" can include an electrical connection.

Figure 1:
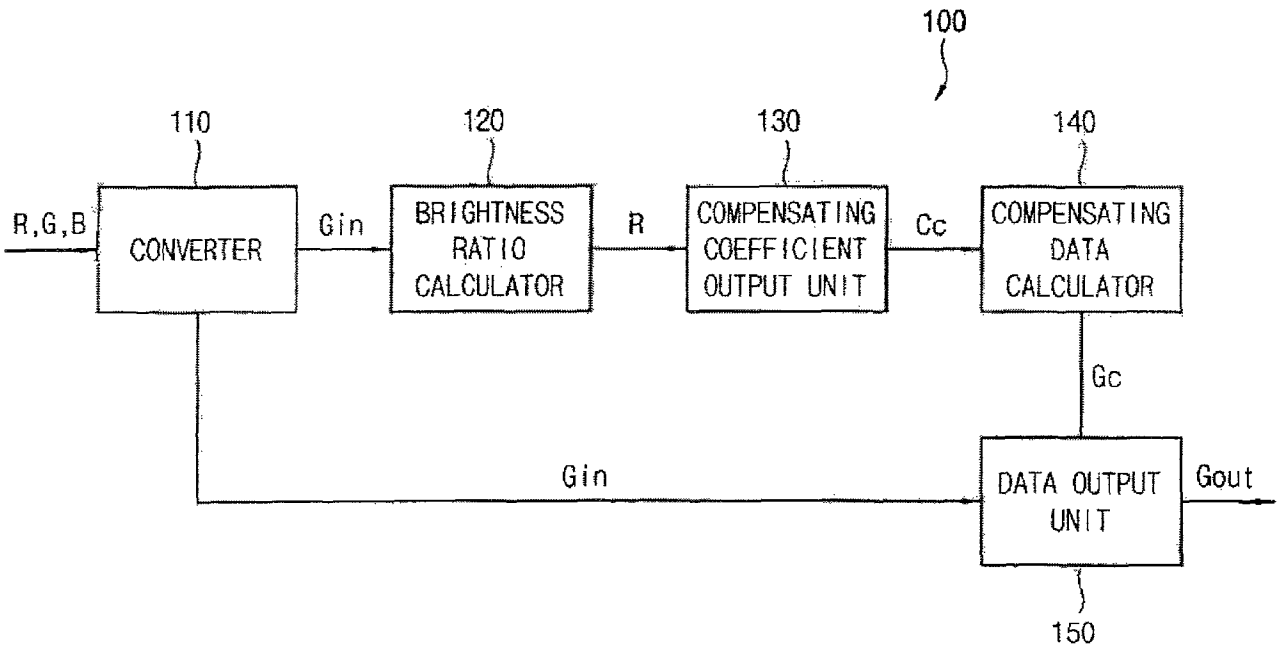
FIG. 1 is a block diagram illustrating a data compensating device according to example embodiments.

Referring to FIG. 1, a data compensating device 100 includes a converter 110, a brightness ratio calculator 120, a compensating coefficient output unit 130, a compensating data calculator 140, and a data output unit 150. Depending on embodiments, certain elements may be removed from or additional elements may be added to the data compensating device 100 illustrated in FIG. 1. Furthermore, two or more elements may be combined into a single element, or a single element may be realized as multiple elements. This also applies to the remaining disclosed embodiments.

The converter 110 can generate an input grayscale data Gin by converting an image data R, G, B provided to pixels in a display panel. The converter 110 can receive the image data R, G, D from an external device or a timing controller. The converter 110 can convert the image data R, G, B provided as a digital signal having 6 bits or 8 bits into the grayscale data corresponding to the image data R, G, B and output as the input grayscale data Gin. For example, the image data R, G, B provided as the digital signal having 6 bits is converted into the input grayscale data Gin having 0 through 63 grayscale data. Further, the image data R, G, B provided as the digital signal having 8 bits can be converted into the input grayscale data Gin having 0 through 255 grayscale data.

The brightness ratio calculator 120 can calculate a brightness ratio R of the input grayscale data Gin provided to each of the pixels based on a predetermined gamma value γ and a maximum grayscale data Gmax. The brightness ratio calculator 120 can calculate brightness ratio R by adjusting the gamma value γ into a ratio of the maximum grayscale data Gmax to the input grayscale data Gin. For example, the brightness calculator 120 calculates the brightness ratio R of the input grayscale data Gin based on Equation 1.

$$R = \left(\frac{Gin}{G\max}\right)^{\gamma} \qquad \text{[EQUATION 1]}$$

Figure 2:
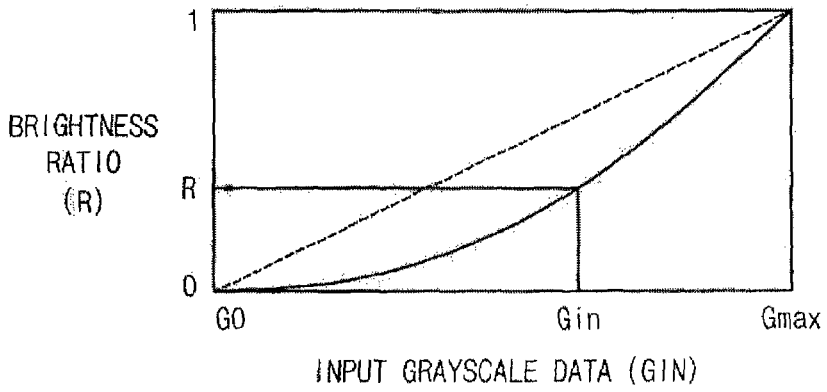
FIG. 2 is a diagram for describing an operation of a brightness ratio calculator included in the data compensating device of FIG. 1.

Where, R is brightness ratio, Gin is the input grayscale data, Gmax is the maximum grayscale data, and γ is the gamma value. The brightness ratio calculator 120 can calculate the brightness ratio R of the input grayscale data Gin corresponding to a gamma curve having the predetermined gamma value γ as described in FIG. 2. For example, the gamma value γ can be about 2.2. The brightness ratio calculator 120 can calculate the brightness ratio R corresponding to the gamma curve having about 2.2 gamma value γ based on the equation 1.

Figure 3:
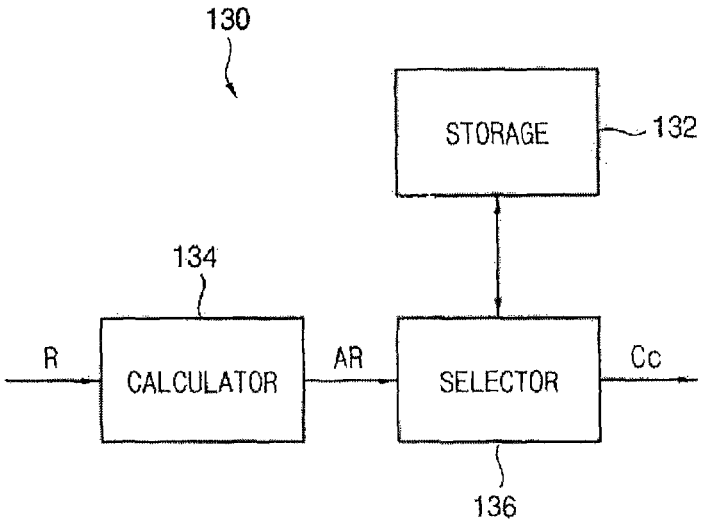
FIG. 3 is a diagram illustrating an example embodiments of a compensating coefficient output unit included in the data compensating device of FIG. 1.

The compensating coefficient output unit 130 can output a predetermined compensating coefficient Cc based on the brightness ratio R of the input grayscale data Gin. Referring to FIG. 3, the compensating coefficient output 130 includes a storage 132, a calculator 134, and a selector 136. The storage 132 can store the compensating coefficient Cc corresponding to the brightness ratio R. The compensating coefficient Cc can be predetermined based on a property of the display. The compensating coefficient Cc can be a value to compensate the input grayscale data Gin when the display device is driven in an automatic current limitation (ACL) driving technology. Power consumption of the display panel can increase as the brightness ratio R increases. The compensating coefficient Cc can increase as the brightness ratio R increases. The storage 132 can be implemented as a look up table (LUT) that stores the compensating coefficient Cc corresponding to the brightness ratio R. The brightness ratio R can have a value in a range from 0 to 1. The compensating coefficient Cc can be stored in the look up table. The calculator 134 can calculate a mean value, or the average, (AR) of the brightness ratio R of the input grayscale data Gin provided from the brightness ratio calculator 120 during a frame. The selector 136 can receive the mean value AR of the brightness ratio R from the calculator 134. The selector 136 can select the compensating coefficient Cc corresponding to the mean value AR of the brightness ratio R from the storage 132.

The compensating data calculator 140 can calculate the compensating grayscale data Gc of all of the grayscale data based on the compensating coefficient Cc. For example, the compensating data calculator 140 calculates compensating grayscale data Gc corresponding to 0 through 255 grayscale data based on the compensating coefficient Cc when the image data R, G, B provided as the digital signal having 8 bits is displayed on the display panel. In some example embodiments, the compensating data calculator 140 calculates the compensating grayscale data Gc based on Equation 2.

$$Gc = Gx - \left(\frac{Gx}{G\max} \times Cc\right) \qquad \text{[EQUATION 2]}$$

Where Gc is the compensating grayscale data, Gx is the grayscale data, Gmax is the maximum data, the Cc is the compensating coefficient. The compensating data calculator 140 can calculate the compensating grayscale data Gc by subtracting a multiplied value of the compensating coefficient Cc and a ratio of the maximum grayscale data Gmax to the grayscale data Gx from each of the grayscale data Gx. Amount of compensating (that is, a difference between the grayscale data Gx and a compensating grayscale data Gc corresponding to the grayscale data Gx) can linearly increase as the grayscale data Gx increases. For example, when the image data R, G, B having 8 bits is provided and the compensating coefficient Cc is about 20, the compensating grayscale data Gc corresponding to the 0 grayscale data Gx can be 0. Further, when the image data R, G, B having 8 bits is provided and the compensating coefficient Cc is about 20, the compensating coefficient data Gc corresponding the 255 grayscale data Gx can be 235. Here, the compensating data calculator 140 can reduce the power current of the display panel by linearly increasing the amount of the compensating as the grayscale data Gx increases.

In some embodiments, the compensating data calculator 140 calculates the compensating grayscale data Gc based on Equation 3.

$$Gc = Gx - \left[\left(\frac{Gx}{G\max}\right)^{\gamma} \times Cc\right] \qquad \text{[EQUATION 3]}$$

Where Gc is the compensating grayscale data, Gx is the grayscale data, Gmax is the maximum grayscale data, γ is the gamma value, and the Cc is the compensating coefficient. The compensating data calculator 140 can calculate the compensating grayscale data Gc based on the gamma value γ and the compensating coefficient Cc. Amount of the compensation of each of the grayscale data Gx (that is, the difference between the grayscale data Gx and the compensating grayscale data Gc corresponding to the grayscale data Gx) can non-linearly increase when the grayscale data Gx increases. For example, when the image data R, G, B having 8 bits is provided, the compensating coefficient Cc is about 20, and the gamma value γ is about 2.2, the compensating grayscale data Gc corresponding to the 0 grayscale can be 0. Further, when the image data R, G, B having 8 bits is provided, the compensating coefficient Cc is about 20, and the gamma value γ is about 2.2, the compensating grayscale data Gc corresponding to the 255 grayscale can be 235. Here, the amount of the compensating can non-linearly increased. Specifically, the amount of the compensating in a low grayscale data can be relatively small than the amount of the compensating in a high grayscale. Thus, a distortion of the image in the low grayscale can be prevented by reducing the amount of the compensating in the low grayscale in the compensating data calculator 140.

The data output unit 150 can output the compensating grayscale data Gc corresponding to the input grayscale data Gin as the output grayscale data Gout. In some example embodiments, the data output unit 150 receives the input grayscale data Gin of a next frame provided from the converter 110 and outputs the compensating grayscale data Gc corresponding to the input grayscale data Gin as the output grayscale data Gout. That is, the data output unit 150 can calculate the compensating grayscale data Gc while the image data R, G, B of an Nth frame is displayed on the display panel, where the N is an integer equal to or greater than 1. The data output unit 150 can output the compensating grayscale data Gc corresponding to the input grayscale data Gin of an (N+1)th frame as the output grayscale data Gout. In some embodiments, the data output unit 150 outputs the compensating grayscale data Gc corresponding to the input grayscale data Gin stored in a frame memory as the output grayscale data Gout. Here, the converter 110 can further include the frame memory that stores the input grayscale data Gin per frame. That is, the data compensating device 100 can store the input grayscale data Gin of the Nth frame in the frame memory, calculate the compensating grayscale data Gc, and output the compensating grayscale data Gc corresponding to the input grayscale data Gin of the Nth frame stored in the frame memory.

As described above, the data compensating device 100 can calculate the brightness ratio R of the input grayscale data Gin based on the predetermined gamma value γ and the maximum grayscale data Gmax, output the predetermined compensating coefficient Cc based on the brightness ratio, and calculate the compensating grayscale data Gc based on the compensating coefficient Cc. Here, the display quality can be improved by calculating the brightness ratio R based on the gamma value and the ratio of the maximum grayscale data Gmax to the input grayscale data Gin.

Figure 4:
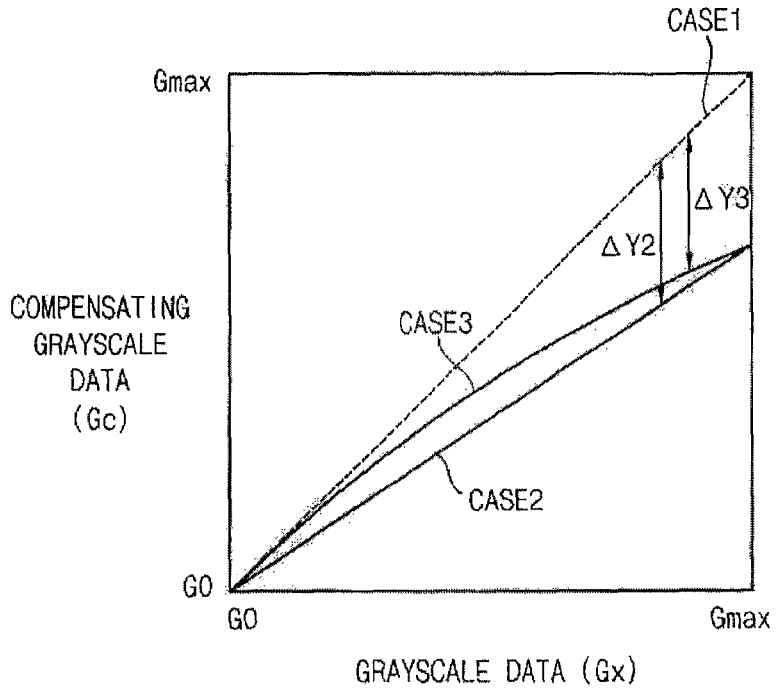
FIG. 4 is a diagram for describing an operation of a compensating data calculator included in the data compensating device of FIG. 1.

FIG. 4 is a diagram for describing an operation of a compensating data calculator included in the data compensating device of FIG. 1.

Referring to FIG. 4, the compensating data calculator calculates the compensating data Gc of all of the grayscale data Gx based on the compensating coefficient. Each of the grayscale data Gx can output the compensating grayscale data Gc as it is when the display device is not driven in an auto current limitation driving technology (CASE1). Amount of a compensating ΔY2 can linearly increase as the grayscale data Gx increases when the compensating data calculator calculates the compensating grayscale data Gc using the Equation 2 (CASE2). Here, the amount of the compensating ΔY2 can be the difference between the grayscale data Gx and the compensating grayscale data Gc. Thus, a current consumption can be reduced by linearly increasing the amount of the compensating ΔY2 as the grayscale data Gx increases when the compensating data calculator calculates the compensating grayscale data Gc using the Equation 2. The amount of the compensating ΔY3 can non-linearly increase as the grayscale data Gx increases when the compensating data calculator calculates the compensating grayscale data Gc using the Equation 3 (CASE3). Here, the amount of the compensating ΔY3 can be the difference between the grayscale data Gx and the compensating grayscale data Gc. That is, a distortion of an image in the low grayscale data Gx can be prevented by reducing the amount of the compensating ΔY3 in the low grayscale data Gx when the compensating data calculator calculates the compensating grayscale data Gc using the Equation 3 (CASE3).

Figure 5:
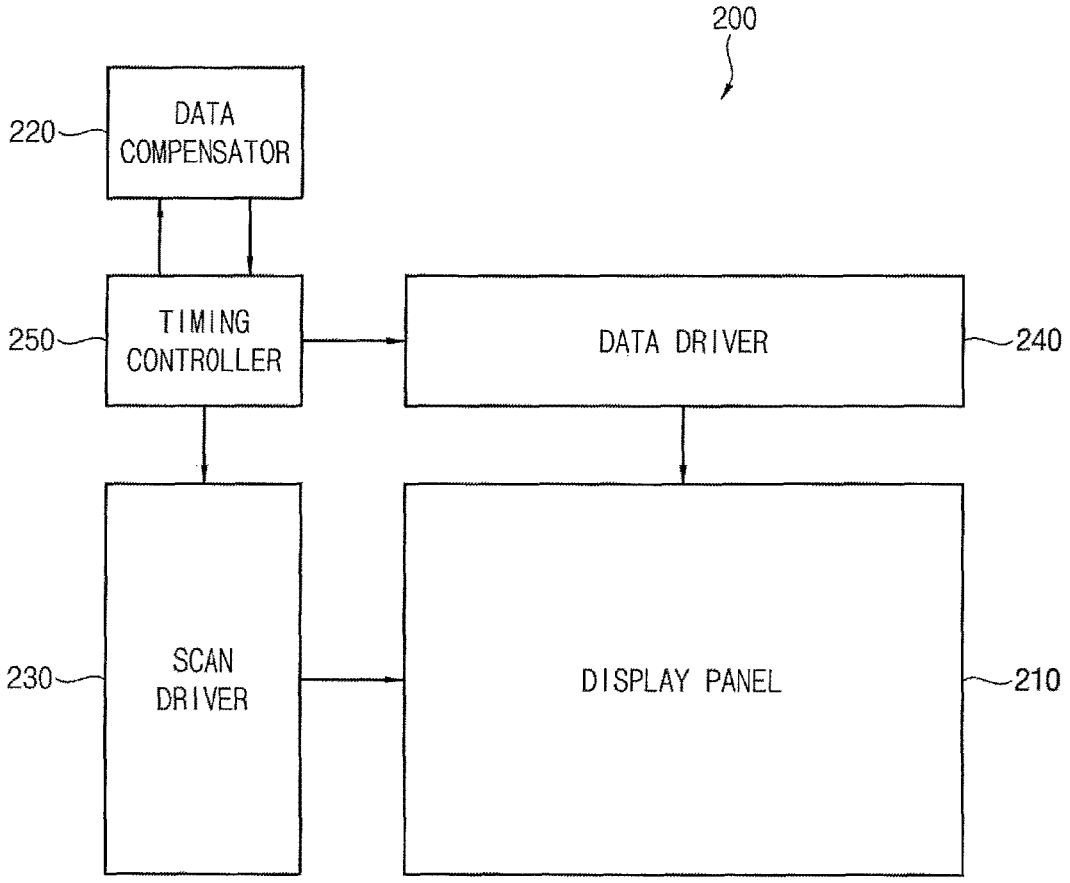
FIG. 5 is a block diagram illustrating a display device according to example embodiments.

FIG. 5 is a block diagram illustrating a display device according to example embodiments.

Referring to FIG. 5, a display device 200 includes a display panel 210, a data compensator 220, a scan driver 230, a data driver 240, and a timing controller 250. Here, the data compensator 220 can correspond to the data compensating device 100 of FIG. 1.

The display panel 210 can include a plurality of pixels. A plurality of data lines and a plurality of scan lines can be disposed on the display panel 210. The pixels can be disposed in intersection regions of the data lines and the scan lines. In some example embodiments, each of the pixels includes a pixel circuit, a driving transistor, and an organic light-emitting diode (OLED). In this case, the pixel circuit can control a current flowing through the OLED based on a data signal, where the data signal is provided via the data line in response to the scan signal, where the scan signal is provided via the scan line.

The scan driver 230 can provide the scan signal to the pixels through the scan lines. The data driver 240 can provide the data signal to the pixels through the data lines. The timing controller 250 can generate control signals that control the scan driver 250 and the data driver 240.

The data compensator 220 can convert an image data provided to the pixels into an input grayscale data during a frame, calculate a compensating grayscale data based on brightness ratio of the input grayscale data, and output a compensating grayscale data corresponding to the input grayscale data. For example, the data compensator 220 includes a converter, a brightness ratio calculator, a compensating coefficient output unit, a compensating data calculator, and a data output unit. The converter can generate the input grayscale data by converting the input data provided to the pixels in the display panel. The converter can convert the image data provided as a digital signal having 6 bits or 8 bits into the grayscale data corresponding to the image data and output as the input grayscale data. The brightness ratio calculator can calculate the brightness ratio of the input grayscale data provided to each of the pixels based on a predetermined gamma value and a maximum grayscale data. The brightness ratio calculator can calculate the brightness ratio by adjusting the gamma value to a ratio of the maximum grayscale data to the input grayscale data. The brightness calculator can calculate the input grayscale data using the Equation 1. The compensating coefficient output unit can output a predetermined compensating coefficient based on the brightness ratio of the input grayscale data. The compensating coefficient output unit can include a storage, a calculator, and a selector. The storage can store the compensating coefficient corresponding to the brightness ratio. The compensating coefficient can be a value to compensate the input grayscale data when the display device is driven in the automatic current limitation driving technology. For example, the compensating coefficient increases as the brightness ratio increases. The storage can be implemented as a look up table that stores the compensating coefficient corresponding to the brightness ratio. The calculator can calculate a mean value of the brightness ratio of the input grayscale data provided from the brightness calculator. The selector can select the compensating coefficient corresponding to the mean value of the brightness ratio from the storage. The compensating data calculator can calculate the compensating grayscale data of all of the grayscale data based on the compensating coefficient. In some example embodiments, the compensating data calculator calculates the compensating coefficient data using the Equation 2. Here, the compensating data calculator can reduce the consumption current of the display panel 210 by linearly increasing an amount of compensating, that is, the difference between the grayscale data and a compensating grayscale data corresponding to the grayscale data as the grayscale data increases. In other example embodiments, the compensating data calculator calculates the compensating grayscale data using the equation 3. Here, the compensating calculator can prevent a distortion of the image in low grayscale data by reducing the amount of the compensating, that is, the difference between the grayscale data and the compensating grayscale data corresponding to the grayscale data. In some example embodiments, the data output unit receives the input grayscale data of a next frame provided from the converter and outputs the compensating grayscale data corresponding to the input grayscale data as the output grayscale data. In some embodiments, the data output unit outputs the compensating grayscale data corresponding to the input grayscale data stored in a frame memory as the output grayscale data. Here, the converter can further include the frame memory that stores the input grayscale data per a frame. The data compensator 220 can be located in the timing controller 250 or coupled to the timing controller 250.

As described above, the data compensator 220 can calculate the brightness ratio of the input grayscale data based on the predetermined gamma value and the maximum grayscale data, output the predetermined compensating coefficient based on the brightness ratio, and calculate the compensating grayscale data based on the compensating coefficient. Here, the brightness ratio can be calculated by adjusting a gamma value to a ratio of the maximum grayscale data to the input grayscale data. Thus, the display device 200 that includes the data compensator 220 can improve a display quality when the display device 200 is driven in the auto current limitation driving technology.

Figure 6:
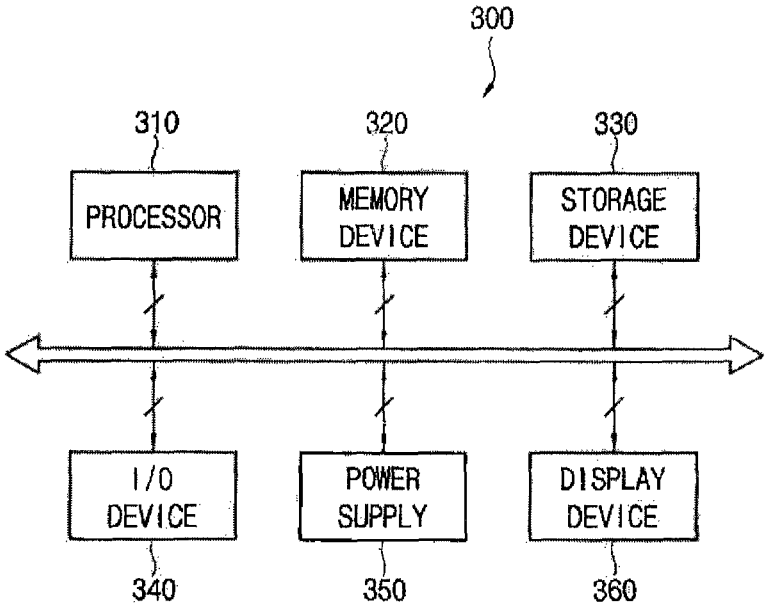
FIG. 6 is a block diagram illustrating an electronic device that includes the display device of FIG. 5.
Figure 7:
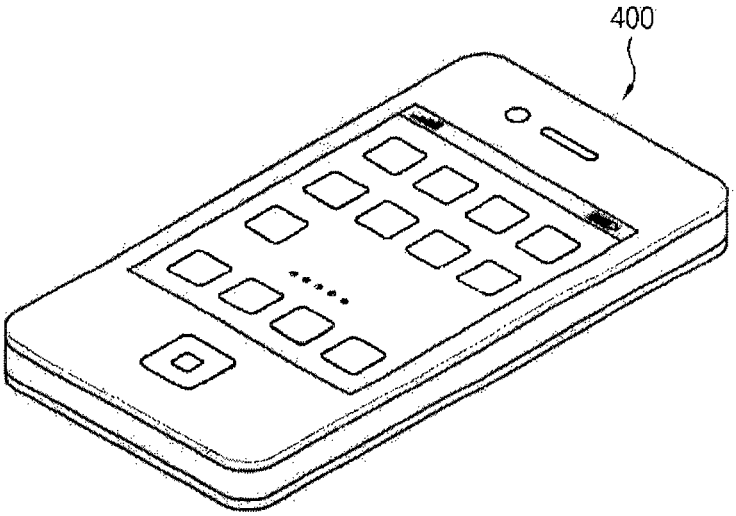
FIG. 7 is a diagram illustrating an example embodiment in which the electronic device

FIG. 6 is a block diagram illustrating an electronic device that includes the display device of FIG. 5. FIG. 7 is a diagram illustrating an example embodiment in which the electronic device FIG. 6 is implemented as a smartphone.

Referring to FIGS. 6 and 7, an electronic device 300 includes a processor 310, a memory device 320, a storage device 330, an input/output (I/O) device 340, a power device 350, and a display device 360. Here, the display device 360 can correspond to the display device 200 of FIG. 5. In addition, the electronic device 300 can further include a plurality of ports for communicating a video card, a sound card, a memory card, a universal serial bus (USB) device, other electronic device, etc. Although it is illustrated in FIG. 7 that the electronic device 300 is implemented as a smartphone 400, a kind of the electronic device 300 is not limited thereto.

The processor 310 can perform various computing functions. The processor 310 can be a microprocessor, a central processing unit (CPU), etc. The processor 310 can be coupled to other components via an address bus, a control bus, a data bus, etc. Further, the processor 310 can be coupled to an extended bus such as peripheral component interconnect (PCI) bus. The memory device 320 can store data for operations of the electronic device 300. For example, the memory device 320 includes at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 330 can be a solid stage drive (SSD) device, a hard disk drive (HDD) device, a CD-ROM device, etc.

The I/O device 340 can be an input device such as a keyboard, a keypad, a touchpad, a touch-screen, a mouse, etc., and an output device such as a printer, a speaker, etc. In some example embodiments, the display device 360 is included in the I/O device 340. The power device 350 can provide a power for operations of the electronic device 300. The display device 360 can communicate with other components via the buses or other communication links. As described above, the display device 360 can include a display panel, a data compensator, a scan drive, a data driver, and a timing controller. The display panel can include a plurality of pixels. The data compensator can convert an image data provided to the pixels during a frame into an input grayscale data, calculate a compensating grayscale data based on a brightness ratio of the input grayscale data, and output a compensating grayscale data corresponding to the input grayscale data. Specifically, the data compensator can include a converter, a brightness ratio calculator, a compensating coefficient output unit, a compensating data calculator, and a data output unit. The converter can generate the input grayscale data by converting the image data provided to the pixels in the display panel. The brightness ratio calculator can calculate the brightness ratio of the input grayscale data provided to each of the pixels based on a predetermined gamma value and a maximum grayscale data. The brightness ratio calculator can calculate the brightness ratio by adjusting the gamma value to a ratio of the maximum grayscale data to the input grayscale data. The compensating grayscale output unit can calculate a mean value of the brightness ratio of the input grayscale data provided from the brightness ratio calculator during a frame and select a compensating coefficient corresponding to the mean value of the brightness ratio. Here, the compensating coefficient can be a value to compensate the input grayscale data when the display device 360 is driven in an automatic current limitation driving technology. In some example embodiments, the compensating data calculator decreases the current consumption of the display panel by linearly increasing amount of the compensating of the grayscale data, that is, the difference between the grayscale data and the compensating grayscale data corresponding to the grayscale data as the grays scale increases. In some embodiments, the compensating data calculator non-linearly increases the amount of the compensating. Here, the compensating data calculator can reduce the amount of the compensating in a low grayscale data. The data output unit can output the compensating grayscale data corresponding to the input grayscale data as the output grayscale data. In some example embodiments, the data output unit receives the input grayscale data of a next frame provided from the converter and output the compensating grayscale data corresponding to the input grayscale data as the output grayscale data. In some embodiments, the data output outputs the compensating grayscale data corresponding to the input grayscale data stored in the frame memory as the output grayscale data. Here, the converter can further include the frame memory that stores the input grayscale data per a frame.

As described above, the electronic device 300 can reduce the current consumption and improve the display quality of the display device 360 by including the display device 360 that converts the image data provided to the pixels during a frame into the input grayscale data, selects the compensating coefficient based on the brightness ratio of the input grayscale data, and calculates the input grayscale data based on the compensating coefficient when the display device 360 is driven in the automatic current limitation driving technology.

The described technology can be applied to a display device and an electronic device including the display device. For example, the described technology can be applied to a computer monitor, a laptop computer, a digital camera, a cellular phone, a smartphone, a smart pad, a tablet computer, a television, a personal digital assistant (PDA), a portable multimedia player (PMP), a MP3 player, a navigation system, a game console, a video phone, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the inventive technology. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A data compensating device for a display device, comprising:

a converter configured to convert image data corresponding to a plurality of pixels in a display panel into input grayscale data and provide the input grayscale data;

a brightness ratio calculator configured to calculate a brightness ratio of the input grayscale data for each pixel based on a predetermined gamma value and a maximum grayscale data;

a compensating coefficient output unit configured to output a predetermined compensating coefficient based on the brightness ratio;

a compensating data calculator configured to calculate compensating grayscale data corresponding to all of the grayscale data based on the compensating coefficient; and a data output unit configured to provide the compensating grayscale data corresponding to the input grayscale data as output grayscale data to the pixels, wherein the compensating data calculator is further configured to calculate the compensating grayscale data corresponding to all of the grayscale data based on an equation, $$Gc = Gx - \left[\left(\frac{Gx}{G\max}\right)^{\gamma} \times Cc\right],$$

where Gc is the compensating grayscale data, Gx is the grayscale data, Gmax is the maximum grayscale data, γ is the gamma value, and Cc is the compensating coefficient.

2. The data compensating device of claim 1, wherein the brightness ratio calculator is further configured to calculate the brightness ratio based on an equation, $$R = \left(\frac{Gin}{G\max}\right)^{\gamma},$$

where R is the brightness ratio, Gin is the input grayscale data, Gmax is the maximum grayscale data, and γ is the gamma value.

3. The data compensating device of claim 1, wherein the compensating coefficient output unit includes:

a storage configured to store the compensating coefficient corresponding to the brightness ratio;

a calculator configured to calculate a mean value of the brightness ratio of the input grayscale data for a frame; and a selector configured to select the compensating coefficient corresponding to the mean value from the storage.

4. The data compensating device of claim 3, wherein the storage includes a look up table (LUT) configured to store the compensating coefficient corresponding to the brightness ratio.

5. The data compensating device of claim 1, wherein the data output unit is further configured to output the compensating grayscale data corresponding to the input grayscale data of a next frame provided from the converter as the output grayscale data.

6. The data compensating device of claim 1, wherein the converter further includes a frame memory configured to store the input grayscale data every frame.

7. The data compensating device of claim 6, wherein the data output unit is further configured to output the compensating grayscale data corresponding to the input grayscale data stored in the frame memory as the output grayscale data.

8. A display device comprising:

a display panel including a plurality of pixels;

a data compensator configured to i) convert image data corresponding to the pixels into input grayscale data, ii) output a compensating coefficient based on a brightness ratio of the input grayscale data for each of the pixels, and iii) calculate the compensating data based on the compensating coefficient;

a scan driver configured to provide a scan signal to the pixels;

a data driver configured to provide a data signal of the pixels; and a timing controller configured to generate a control signal so as to control the scan driver and the data driver.

9. The display device of claim 8, wherein the data compensator includes:

a converter configured to convert the image data into the input grayscale data and provide the input grayscale data;

a brightness ratio calculator configured to calculate the brightness ratio of the input grayscale data for each pixel based on a predetermined gamma value and a maximum grayscale data;

a compensating coefficient output unit configured to output a predetermined compensating coefficient based on the brightness ratio;

a compensating data calculator configured to calculate the compensating grayscale data corresponding to all of the grayscale data based on the compensating coefficient; and a data output unit configured to provide the compensating grayscale data corresponding to the input grayscale data as output grayscale data to the pixels, wherein the compensating data calculator is further configured to calculate the compensating grayscale data corresponding to all of the grayscale data based on an equation, $$Gc = Gx - \left(\frac{Gx}{G\max} \times Cc\right),$$

where Gc is the compensating grayscale data, Gx is the grayscale data, Gmax is the maximum grayscale data, γ is the gamma value, and Cc is the compensating coefficient.

10. The display device of claim 9, wherein the brightness ratio calculator is further configured to calculate the brightness ratio based on an equation, $$R = \left(\frac{Gin}{G\max}\right)^{\gamma},$$

where R is the brightness ratio, Gin is the input grayscale data, Gmax is the maximum grayscale data, and γ is the gamma value.

11. The display device of claim 9, wherein the compensating coefficient output unit includes:

a storage configured to store the compensating coefficient corresponding to the brightness ratio;

a calculator configured to calculate a mean value of the brightness ratio of the input grayscale data for a frame; and a selector configured to select the compensating coefficient corresponding to the mean value from the storage.

12. The display device of claim 11, wherein the storage includes a look up table (LUT) configured to store the compensating coefficient corresponding to the brightness ratio.

13. The display device of claim 9, wherein the data output unit is further configured to output the compensating grayscale data corresponding to the input grayscale data of a next frame provided from the converter as the output grayscale data.

14. The display device of claim 9, wherein the converter further includes a frame memory configured to store the input grayscale data every frame.

15. The display device of claim 14, wherein the data output unit is further configured to output the compensating grayscale data corresponding to the input grayscale data stored in the frame memory as the output grayscale data.

16. The display device of claim 9, wherein the data compensator is included in the timing controller or is coupled to the timing controller.

* * * * *